United States Patent [19]

Jonsson

[11] 4,207,805

[45] Jun. 17, 1980

[54] FEED BEAM

[75] Inventor: Nils G. Jonsson, Täby, Sweden

[73] Assignee: Atlas Copco Aktiebolag, Nacka, Sweden

[21] Appl. No.: 904,214

[22] Filed: May 9, 1978

[30] Foreign Application Priority Data

May 11, 1977 [ZA] South Africa ..... 77/2816

[51] Int. Cl.[2] ..... B23Q 5/033; E21C 5/06; F15B 11/16; F15B 13/06

[52] U.S. Cl. ..... 91/508; 91/533; 92/137; 92/151; 173/31; 173/147

[58] Field of Search ..... 92/137, 151, 150, 76; 91/533, 508; 173/147, 31

[56] References Cited

U.S. PATENT DOCUMENTS

| | | | |
|---|---|---|---|
| 404,472 | 6/1889 | Dunn | 91/533 X |
| 1,272,459 | 7/1918 | Kitts, Jr. | 92/137 X |
| 2,029,223 | 1/1936 | Curtis | 92/151 X |
| 2,130,982 | 9/1938 | Gartin | 92/137 X |
| 2,960,208 | 11/1960 | Sibley et al. | 92/137 |
| 3,131,603 | 5/1964 | Hadekel | 92/138 X |
| 3,212,738 | 10/1965 | Curtis et al. | |
| 3,535,985 | 10/1970 | Attebo | 92/137 |
| 3,744,575 | 7/1973 | Strommes | 173/31 |
| 3,990,583 | 11/1976 | Nishida et al. | 91/420 |

*Primary Examiner*—Irwin C. Cohen
*Attorney, Agent, or Firm*—Frishauf, Holtz, Goodman & Woodward

[57] ABSTRACT

A feed beam for a rock drill comprises a box girder (13), a saddle (10) slidable along the box girder, and two power units (20,20*a*) inserted into the ends of the box girder.

Each power unit comprises a pair of fixed pulleys (22,24) located outside the end of the box girder, an hydraulic jack (26) carrying a pair of movable pulleys (28,30) within the box girder, and a cable coupled between the power unit and the saddle and passing over the four pulleys.

23 Claims, 5 Drawing Figures

FEED BEAM

REFERENCE TO PATENTS PERTINENT TO THE INVENTION

U.S. Pat. No. 3,535,985 Attebo
U.S. Pat. No. 3,744,575 Strömnes
U.S. Pat. No. 3,212,738 Curtis This invention relates to a feed beam comprising an elongate main body having elongate guide means that carries a saddle which is adapted to carry a rock drill, and hydraulic jack means coupled to the saddle via a flexible member that passes over pulleys in order to feed the saddle along the guide means.

A feed beam or merely a mast having such an arrangement is shown in U.S. Pat. No. 3,535,985. It comprises a complex open mast made up of several beams and struts and a double acting hydraulic jack.

It is desirable to make a simpler feed beam which can be easily assembled and disassembled and which is very robust. It is also desirable that feed beams of various length can be assembled in short time from a few components and that the feed beam can be repaired on location in short time when necessary. A feed beam according to the invention meets these requirements.

An embodiment of the invention will now be described by way of example with reference to the accompanying drawings.

DETAILED DESCRIPTION OF A PREFERRED EMBODIMENT

Figures 1, 2:
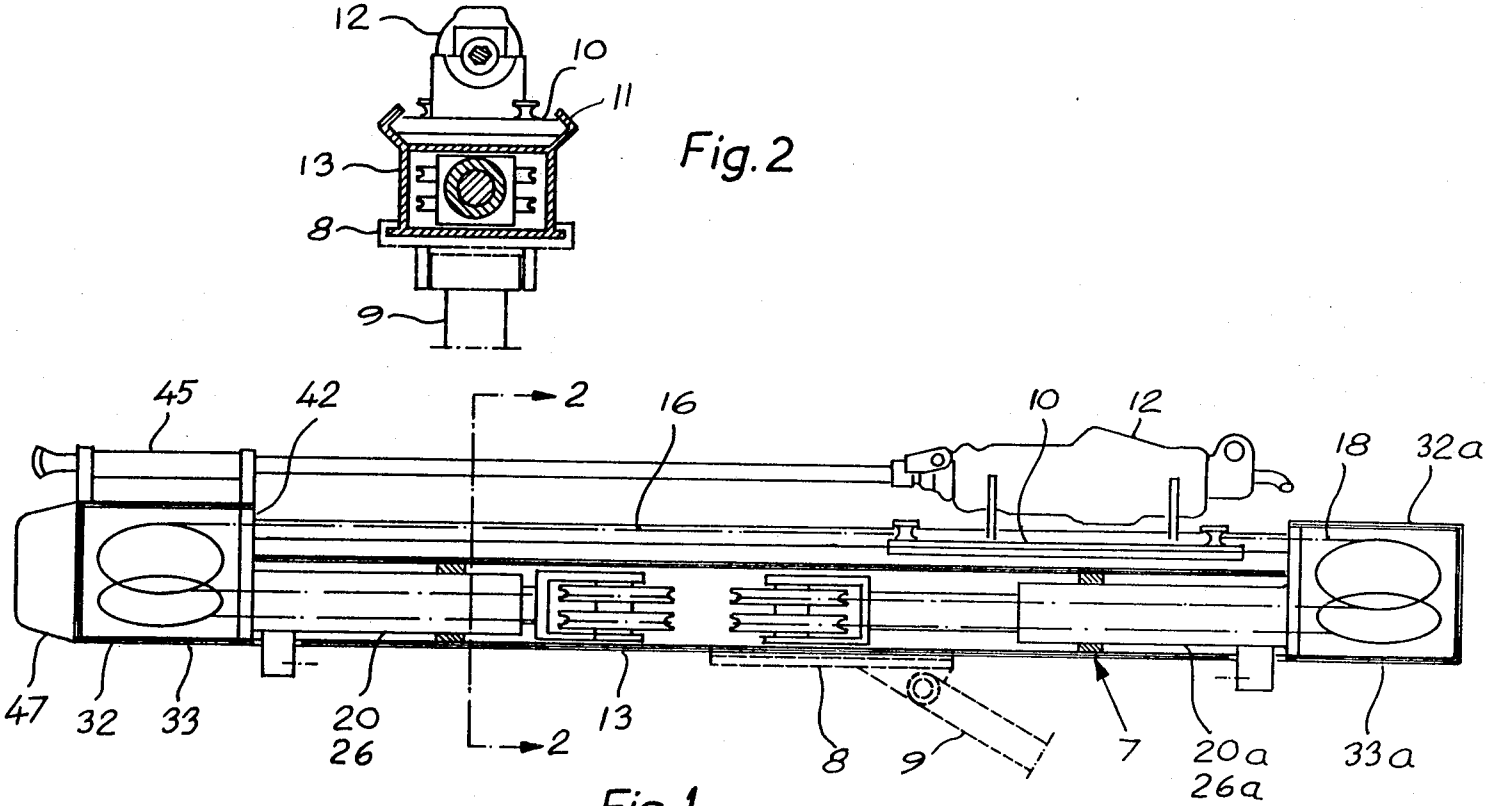
FIG. 1 is a longitudinal section of a feed beam according to the invention.
FIG. 2 is a transverse section taken along line 2—2 in FIG. 1.

In FIG. 1 there is shown a feed beam 7 that is mounted to be longitudinally slidable and lockable in a holder 8 that is mounted on the outer end of a support in the form of a boom 9. Since the holder 8 and the support 9 are not part of the invention, they are only indicated schematically and the hydraulic jacks conventionally used for extending the feed beam in the holder and for pivoting the holder 8 on the support 9 are not shown. A saddle 10 is slidable along the feed beam 7 and it carries a precussion rock drill 12. The feed beam 10 comprises a main body in the form of a box girder 13 and two identical power units 20 and 20*a* inserted into the ends of the box girder. Each power unit 20 and 20*a* includes a cable 16 and 18 respectively, one end of which is secured to the saddle 10. Along its entire length, the box girder 13 has two guides 11 for the saddle 10.

Figure 3:
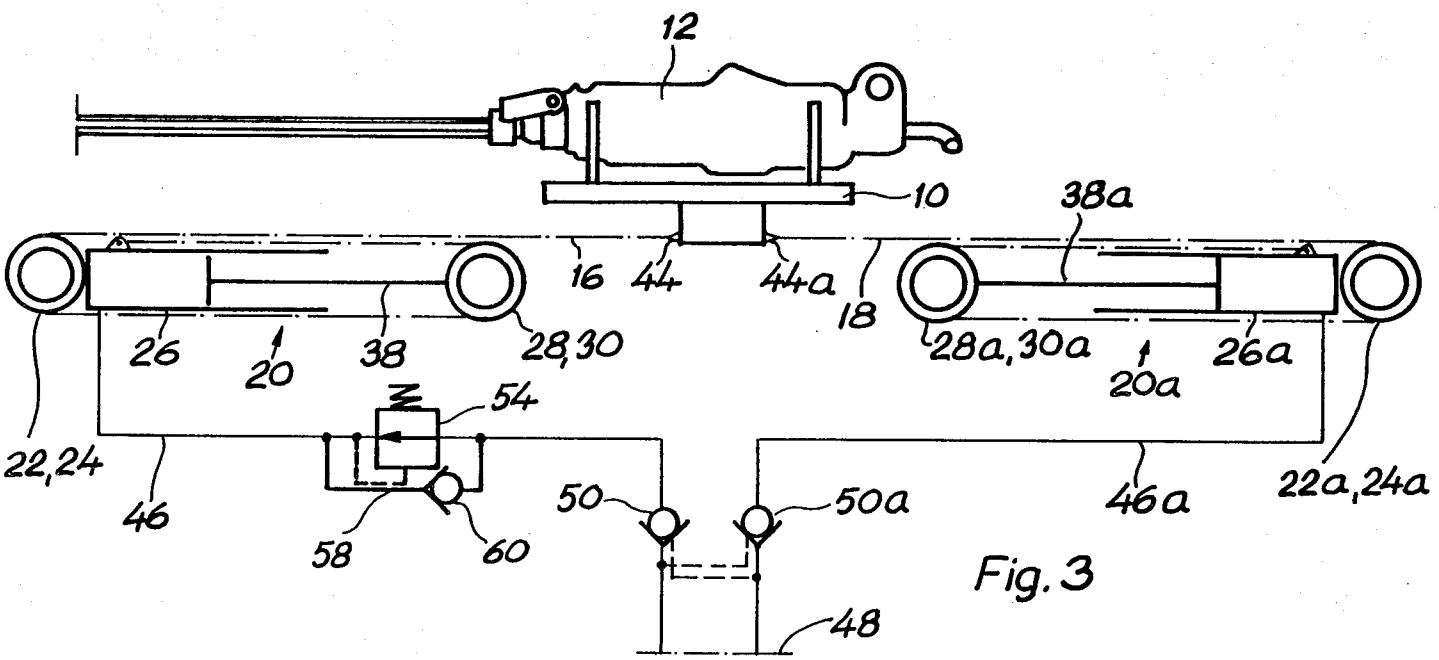
FIG. 3 is a diagrammatic representation of means shown in FIG. 1 for moving a saddle also shown in FIG. 1 along the feed beam.
Figure 5:
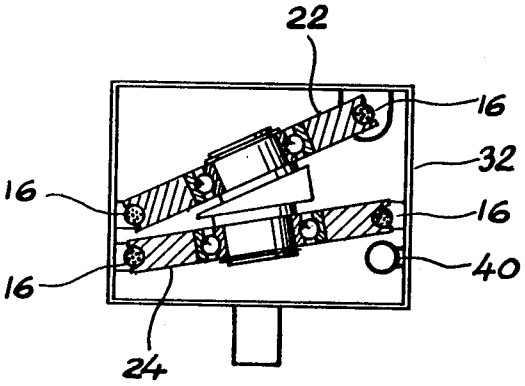
FIG. 5 is a section taken along line 5—5 in FIG. 4.
Figure 4:
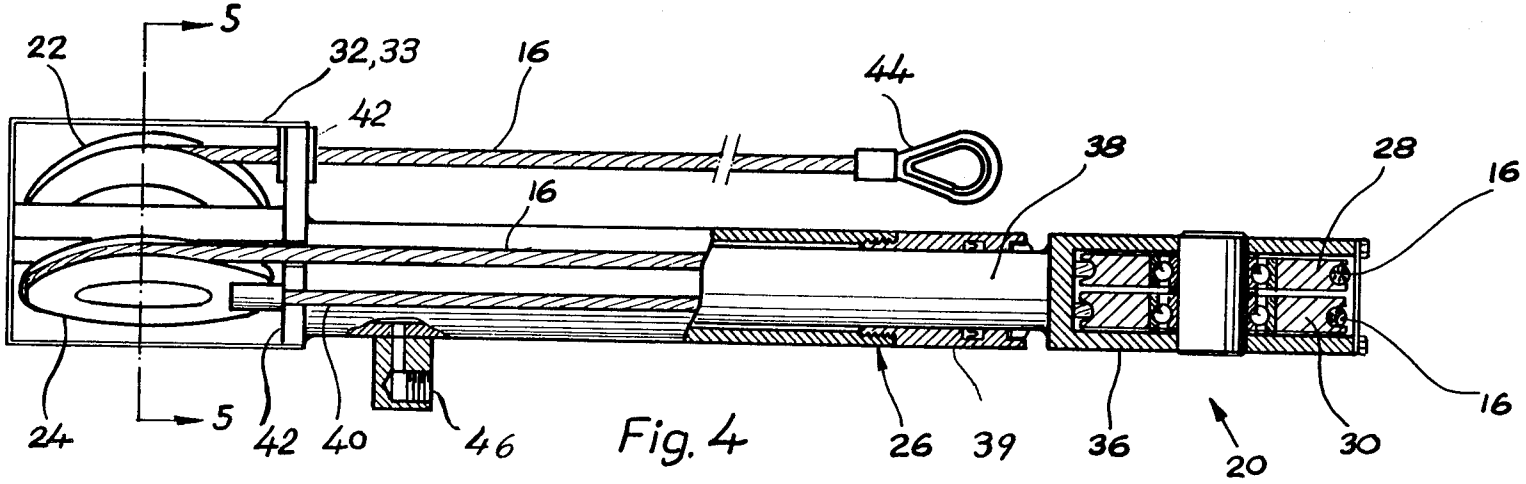
FIG. 4 is a longitudinal view partly in section of a power unit shown in FIG. 1.

The power unit 20 is shown in more detail in FIGS. 3 and 4. It comprises a pair of fixed pulleys 22 and 24, an hydraulic jack 26 and a pair of movable pulleys 28 and 30. The power unit 20 also comprises a housing 32 within which the fixed pulleys are rotatably carried. The housing 32 and its enclosure form a head 33 of the power unit 20. The power unit has a shoulder 42 which forms part of the housing 32 and which abuts against one end of the box girder 13 so that the head 33 with the fixed pulleys 22 and 24 are located outside of the box girder and the hydraulic jack 26 with the movable pulleys 28,30 are located within the box girder. Transversely, the jack 26 takes support against the box girder. The power unit 20 is locked to the box girder by means of non-illustrated lock pins. These lock pins are used to prevent the power unit from falling out of the box girder 13 and they are not stressed during drilling operation. The fixed pulleys 22 and 24 are inclined to each other and to the movable pulleys 28, 30 such as to make the five straight parts of the cable 16 parallel with each other.

The movable pulleys 28 and 30 are carried on a member 36 mounted on the free end of the piston rod 38 of the jack 26. The jack 26 is a plunger jack, i.e. its piston 38 is a cylindrical plunger and constitutes both piston and piston rod. The plunger 38 extends through sealings in a sealing bushing 39.

The cable 16 passes over the inclined fixed pulley 22, the movable pulley 28, the fixed pulley 24 and the movable pulley 30, and it has its one end 40 secured to the shoulder or wall 42. Thus the distance of movement of the other end 44 of the cable 16 connected to the saddle 10 is four times that of the member 36 and the pulleys 28, 30. The cable 16 passes through a friction bushing 43 which prevents the cable from becoming slack when the end 44 of the cable is released from the saddle 10.

In FIG. 1 an elongate drill steel centralizer 45 and a support 47 are shown mounted on the head 33. The support 47 is arranged to take support against the rock face during drilling. The centralizer and the support are not shown in FIG. 3. Both the centralizer 45 and the support 47 are removable from the power unit 20. Apart from the drill steel centralizer 45 and the support 47, the power unit 20*a* is identical with the power unit 20*a*. However, the centralizer 45 and the support 47 can be dismounted from the power unit 20 which then becomes identical with the power unit 20*a*. The cable 18 of power unit 20*a* is connected in the same manner as described above. For convenience herein corresponding parts of the two power units are identified by the same numbers but differenitated by the suffix "a" for the parts of power unit 20.

The jacks 26 and 26*a* are single acting hydraulic jacks. The power lines 46 and 46*a* of jacks 26 and 26*a* are actuated from a pressure source 48. They contain pilot controlled non-return valves 50 and 50*a* respectively so that the jacks 26 and 26*a* will be locked in the position into which they have been moved. However, these valves 50 and 50*a* are of the kind that will be opened for reverse flow respectively when lines 46*a* and 46 are pressurized from the pressure source 48.

The power line 46 contains a pressure regulator 54 which is operable to allow either the full pressure from the pressure source 48 or a variable reduced pressure to be fed to the jack 26.

A by-pass line 58 by-passes the control valve 54 and contains a non-return valve 60 through which the jack 26 can be exhausted and which is open for reverse flow when line 46*a* is pressurized.

The feed means operates as follows from a position in which the saddle 10 is at the rear of the feed beam. In this position, the front jack 26 will be fully retracted and rear jack 26*a* fully extended. The pressure line 46 is now connected to the pressure source 48. The jack 26 extends drawing the saddle 10 forwards at four times the rate of movement of the member 36 and the movable pulleys carried thereby. At the same time the cable 18, being substantially inextensible, forces the pulleys 28*a* and 30*a* and the member 36*a* rearwardly retracting the jack 26*a*. As the non-return valve 50*a* has been opened by the pressure in line 46, the jack 26*a* can exhaust through line 46*a*. If a hydraulic pressure of, say 170 bar is applied to the jack 26, the tension in cable 16, and hence between the drill bit and the rock face, may be 400 kp. Pressure regulator 54 may be operated to diminish the pressure applied to the jack 26 so that the force applied to the cable 16, and hence the force between the drill bit and the rock face can be preselected.

The saddle 10 is returned by pressurizing the power line 46*a* and extending jack 26*a*. As the movable pulleys 28*a* and 30*a* move away from fixed pulleys 22*a* and 24*a*, the saddle 10 returns at four times the rate of movement as the pulley carrying member 36*a*. At the same time, the jack 26 exhausts via by-pass line 58 and non-return valves 50 and 60; the non-return valve 50 having been opened by the pressure in line 46*a*.

The illustrated feed beam is very robust because all movable parts and the cables are enclosed within the beam itself. The feed beam is comprised of separate units that can easily be assembled and disassembled. Therefore, the feed beams can be stored disassembled which reduces the costs. Further, one size of the power units can be used with box girders of different length to make up feed beams of different length since the two sets of movable pulleys move conjointly and both sets can be allowed to move past the axial middle point of the box girder. Within some limits the length of the cables need not even be adjusted for different beam lengths. A new cable becomes longer when used, but this lengthening need not be compensated for by any manual adjustment since the length of the cables is not critical. If one of the power units needs repair, it can be replaced in some minutes. The cable need only be disconnected from the saddle before the entire power unit can be taken out of the box girder without the use of any tool.

The feed beam illustrated can be used for rock drilling, for example drifting. It can also be used for rock bolting. In a rock bolting apparatus two feed beams of the kind illustrated can be interconnected side by side and swingable laterally as a unit. One of the feed beams carries on its saddle a rock drill for drilling a hole and the other carries on its saddle a wrench for rotating in the rock bolt into the bore hole just drilled.

What I claim is:

1. A feed beam for a rock drill comprising:

an elongated generally tubular main body (13), elongate guide means (11) on said main body (13) and extending therealong, a saddle (10) which is adapted to carry a rock drill (12) and which is mounted on the main body (13) to be moveable along said guide means, a first power unit (20), means removably mounting said first power unit to one end of the main body, said first power unit extending into the generally tubular main body so that the generally tubular main body encloses at least a major portion of said first power unit, and a second power unit (20*a*), means removably mounting said second power unit to the other end of the main body, said second power unit extending into the generally tubular main body so that the generally tubular main body encloses at least a major portion of said second power unit, said first and second power units being substantially aligned and having a free space axially between them interior of the generally tubular main body, each of said first and second power units comprising a set of at least two fixed pulleys (22,24) at the respective end of said main body, a pressure fluid actuated jack (26), a set of at least two pulleys (28, 30) mounted within the generally tubular main body and operatively coupled to the jack (26) to be movable by the jack towards and away from the fixed pulleys (22, 24), a flexible member (16 and 18, respectively) passing over said fixed and movable pulleys, one end of the flexible member being immovably affixed to said respective power unit and the other end being attached to the saddle such that the flexible member of each power unit pulls the saddle along the feed beam when said jack expands, said first and second power units being arranged to pull the saddle in relative opposite directions, and means coupled to said power units and arranged to abut against the respective end of the main body (13) to transmit the reaction forces from the respective power units to the main body.

2. A feed beam according to claim 1 wherein said first power unit is located at the front end of the feed beam, and further comprising a drill steel centralizer (45) carried by said first power unit (20) and also located at the front end of the feed beam.

3. A feed beam according to claim 1 or 2 further comprising a support (47) for engaging a rock face to be drilled, said support being mounted on said first power unit (20) that is located at the front end of the feed beam.

4. A feed beam according to claim 1 wherein said power units (20,20*a*) comprise respective heads (33,33*a*) arranged to be located outside of said tubular main body (13), said respective fixed sets of pulleys (22,24) being part of said heads.

5. A feed beam according to claim 4 wherein said heads (33,33*a*) comprise said means for abutting against the ends of the tubular main body (13).

6. A feed beam according to claim 4 or 5 further comprising a drill steel centralizer (45) carried by the head (33) that is located at the front end of the feed beam.

7. A feed beam according to claim 4 further comprising a support (45) for engaging the rock face to be drilled, said support being mounted on the head (33) that is located at the front end of the feed beam.

8. A feed beam according to claim 4 wherein said heads (33,33*a*) comprise friction means (43) engaging the flexible members (16 and 18 resp.) to prevent the flexible members from running freely into and out of said heads when the flexible members are uncoupled from the saddle.

9. A feed beam according to claim 1 further comprising fluid supply lines (46,46*a*) of the two jacks (26,26*a*), and pilot operated check valves (50,50*a*) in the supply lines (46,46*a*), the check valves in one supply line being controlled by the pressure in the other supply line and vice versa.

10. A feed beam according to claim 1 further comprising fluid supply lines (46,46*a*) of the jacks (26,26*a*), an adjustable pressure regulator (54) in the supply line (46) of the jack (26) for pulling the saddle (10) forwardly along the feed beam, and a one-way valve (60)

coupled to by-pass the pressure regulator and permit exhaust through the supply line (46) of the jack (26).

11. A feed beam according to any one of claims 1, 9 or 10 wherein said jacks (26,26*a*) are hydraulic jacks.

12. A feed beam for a rock drill comprising:

an elongate generally tubular main body (13), elongate guide means (11) on said main body (13) and extending therealong , a saddle (10) which is adapted to carry a rock drill (12) and which is mounted on the main body (13) to be movable along said guide means, a first power unit (20), means removably mounting said first power unit to one end of the main body, said first power unit extending into the generally tubular main body so that the generally tubular main body encloses at least a major portion of said first power unit, and a second power unit (20*a*), means removably mounting said second power unit to the other end of the main body, said second power unit extending into the generally tubular main body so that the generally tubular main body encloses at least a major portion of said second power unit, said first and second power units being substantially aligned and having a free space axially between them interior of the generally tubular main body, each of said first and second power units comprising a set of at least two fixed pulleys (22,24) at the respective end of said main body, a pressure fluid actuated jack (26), a set of at least two pulleys (28, 30) mounted within the generally tubular main body and operatively coupled to the jack (26) to be movable by the jack towards and away from the fixed pulleys (22,24), and a flexible member (16 and 18, respectively) passing over said fixed and movable pulleys, one end of the flexible member being immovably affixed to said respective power unit and the other end being attached to the saddle such that the flexible member of each power unit pulls the saddle along the feed beam when said jack expands, said first and second power units being arranged to pull the saddle in relative opposite directions, and respective heads (33, 33*a*) arranged to be located outside of said tubular main body (13) and abutting against the ends of said tubular main body, said respective fixed sets of pulleys (22, 24) being part of said heads.

13. A feed beam according to claim 12 further comprising a drill steel centralizer (45) carried by the head (33) that is located at the front end of the feed beam.

14. A feed beam according to claim 12 further comprising a support (45) for engaging the rock face to be drilled, said support being mounted on the head (33) that is located at the front end of the feed beam.

15. A feed beam according to claim 12 wherein said heads (33, 33*a*) comprise friction means (43) engaging the flexible members (16 and 18 respectively) to prevent the flexible members from running freely into and out of said heads when the flexible members are uncoupled from the saddle.

16. A feed beam according to claim 12 further comprising fluid supply lines (46,46*a*) of the two jacks (26,26*a*), and pilot operated check valves (50,50*a*) in the supply lines (46,46*a*), the check valves in one supply line being controlled by the pressure in the other supply line and vice versa.

17. A feed beam according to claims 1 or 12 wherein said tubular main body (13) is a box girder.

18. A feed beam for a rock drill comprising:

an elongate generally tubular main body (13), elongate guide means (11) on said main body (13) and extending therealong, a saddle (10) which is adapted to carry a rock drill (12) and which is mounted on the main body (13) to be movable along said guide means, a first power unit (20), means removably mounting said first power unit to one end of the main body, said first power unit extending into the generally tubular main body so that the generally tubular main body encloses at least a major portion of said first power unit, and a second power unit (20*a*), means removably mounting said second power unit to the other end of the main body, said second power unit extending into the generally tubular main body so that the generally tubular main body encloses at least a major portion of said second power unit, said first and second power units being substantially aligned and having a free space axially between them interior of the generally tubular main body, each of said first and second power units comprising a set of at least two fixed pulleys (22,24) at the respective end of said main body, a pressure fluid actuated jack (26), a set of at least two pulleys (28, 30) mounted within the generally tubular main body and operatively coupled to the jack (26) to be movable by the jack towards and away from the fixed pulleys (22, 24), and a flexible member (16 and 18, respectively) passing over said fixed and movable pulleys, one end of the flexible member being immovably affixed to said respective power unit and the other end being attached to the saddle such that the flexible member of each power unit pulls the saddle along the feed beam when said jack expands, said first and second power units being arranged to pull the saddle in relative opposite directions, said fixed pulleys being mounted at one end of said jack and said movable pulleys being mounted at the other end of said jack, each of said flexible members having segments running aligned with each other and along said jack, said flexible member segments being substantially in parallel with each other.

19. A feed beam according to claim 18 wherein each of said first and second power units comprises two fixed pulleys and two movable pulleys, said flexible member passing over said pulleys to define five flexible member segments extending along said jack, said five flexible member segments being substantially straight and in parallel with each other.

20. A feed beam according to claim 19 wherein said fixed pulleys are inclined relative to each other and to the movable pulleys to maintain said five substantially straight flexible member segments substantially parallel to each other.

21. A feed beam according to claim 18 wherein said power units include means arranged to abut against the respective end of said tubular main body (13) to transmit the reaction forces from the respective power units to the tubular main body.

22. A feed beam according to claim 18 wherein said first power unit is located at the front end of the feed beam, and further comprising a drill steel centralizer (45) carried by said first power unit (20) and also located at the front end of the feed beam.

23. A feed beam according to claims 18 or 22 further comprising a support (47) for engaging a rock face to be drilled, said support being mounted on said first power unit (20) that is located at the front end of the feed beam.

* * * * *